US006816119B2

(12) United States Patent
Ma

(10) Patent No.: US 6,816,119 B2
(45) Date of Patent: Nov. 9, 2004

(54) PCB ANTENNA FOR RECEIVING DIFFERENT POLARIZATION SIGNALS

(75) Inventor: Chun-Chen Ma, Taipei (TW)

(73) Assignee: Tatung Co., Ltd., Taipei (TW)

( * ) Notice: Subject to any disclaimer, the term of this patent is extended or adjusted under 35 U.S.C. 154(b) by 0 days.

(21) Appl. No.: 10/606,746

(22) Filed: Jun. 27, 2003

(65) Prior Publication Data

US 2004/0004572 A1 Jan. 8, 2004

(30) Foreign Application Priority Data

Jul. 3, 2002 (TW) ..... 91210108 U

(51) Int. Cl.[7] ..... H01Q 1/38
(52) U.S. Cl. ..... 343/700 MS
(58) Field of Search ..... 343/700 MS, 909, 343/702, 756

(56) References Cited

U.S. PATENT DOCUMENTS 6,414,641 B1 * 7/2002 Carlson et al. ..... 343/702
6,538,605 B2 * 3/2003 Lebaric et al. ..... 343/700 MS
6,606,062 B2 * 8/2003 Ngounou Kouam et al. .... 343/700 MS
6,636,180 B2 * 10/2003 Lin et al. ..... 343/700 MS

* cited by examiner

*Primary Examiner*—James Vannucci
*Assistant Examiner*—Minh Dieu A
(74) *Attorney, Agent, or Firm*—Bacon & Thomas PLLC

(57) ABSTRACT

A PCB antenna for receiving distinct polarization signal is disclosed, which is formed a plurality of circular electrodes printed on a substrate. There are pluralities of metal splices between the circular electrodes so that each circular electrode is short in order to obtain the best sensitivity for receiving the different polarization signal. The PCB antenna is connected with a signal processing unit via the coaxial fed or the microstrip fed for transmitting the signal the PCB antenna received.

11 Claims, 6 Drawing Sheets

PCB ANTENNA FOR RECEIVING DIFFERENT POLARIZATION SIGNALS

BACKGROUND OF THE INVENTION

1. Field of the Invention

The present invention relates to a PCB antenna and, more particularly, to a PCB antenna for receiving different polarization signals.

2. Description of Related Art

Currently, the use of the wireless communication products is increasingly popular in people's life. For example, everyone has a cell phone and the technology of the mobile communication is evolving into 3G ages. The bluetooth products and the wireless LAN products such as IEEE 802.11b are also very popular in the market. These wireless communication products have to be small in size, good-looking in appearance and convenient to carry. However, the current antenna integrated with the wireless communication product will occupy too much space, resulting in damaging the entirety perception. Moreover, the antenna can receive a single polarization signal. Therefore, it is desirable to provide an improved antenna device to mitigate and/or obviate the aforementioned problems.

SUMMARY OF THE INVENTION

The first object of the present invention is to provide a PCB antenna for receiving different polarization signals, including the co-polar signal and the cross-polar signal, at the same time.

The second object of the present invention is to provide a PCB antenna for receiving different polarization signals in which the PCB antenna is small and light.

The third object of the present invention is to provide a PCB antenna for receiving different polarization signals, which can be integrated with an appearance of an apparatus easily thereby being hidden in the apparatus.

The fourth object of the present invention is to provide a PCB antenna for receiving different polarization signals, which can reduce the cost and improve the yield of the integration of the PCB antenna with the target apparatus.

To achieve the object, the PCB antenna for receiving different polarization signals with a signal processing unit of the present invention compress: a substrate; an emission electrode printed on the substrate, and having a plurality of circular electrodes and a plurality of metal splices for receiving a polarization signal, wherein the metal splices are located between the circular electrodes and respectively connected with each circular electrode; and a receiving unit located one of the ends of the substrate, and connected with the circular electrodes the signal processing unit via an external transmission unit.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
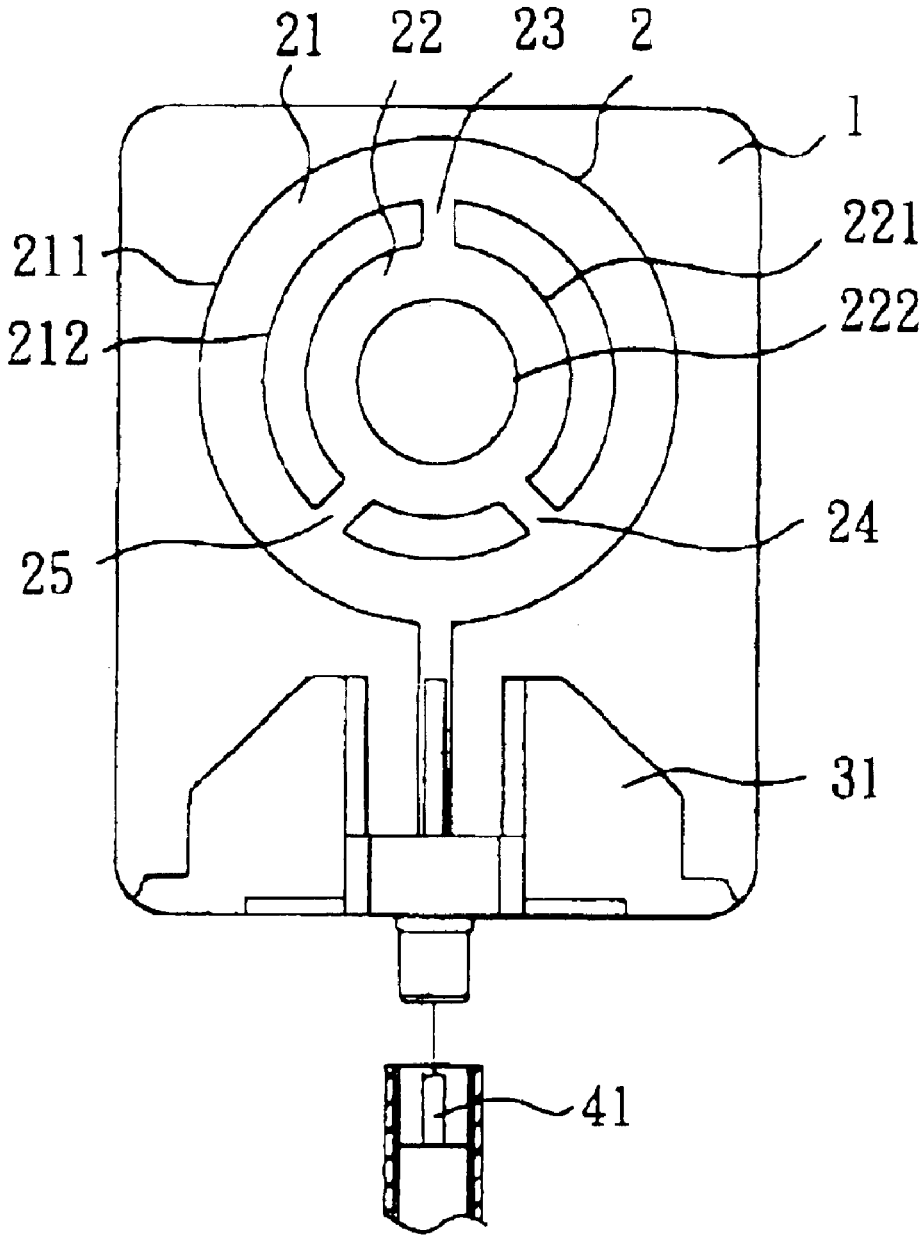
FIG. 1 is a schematic view of the antenna in accordance with the present invention.
Figure 2:
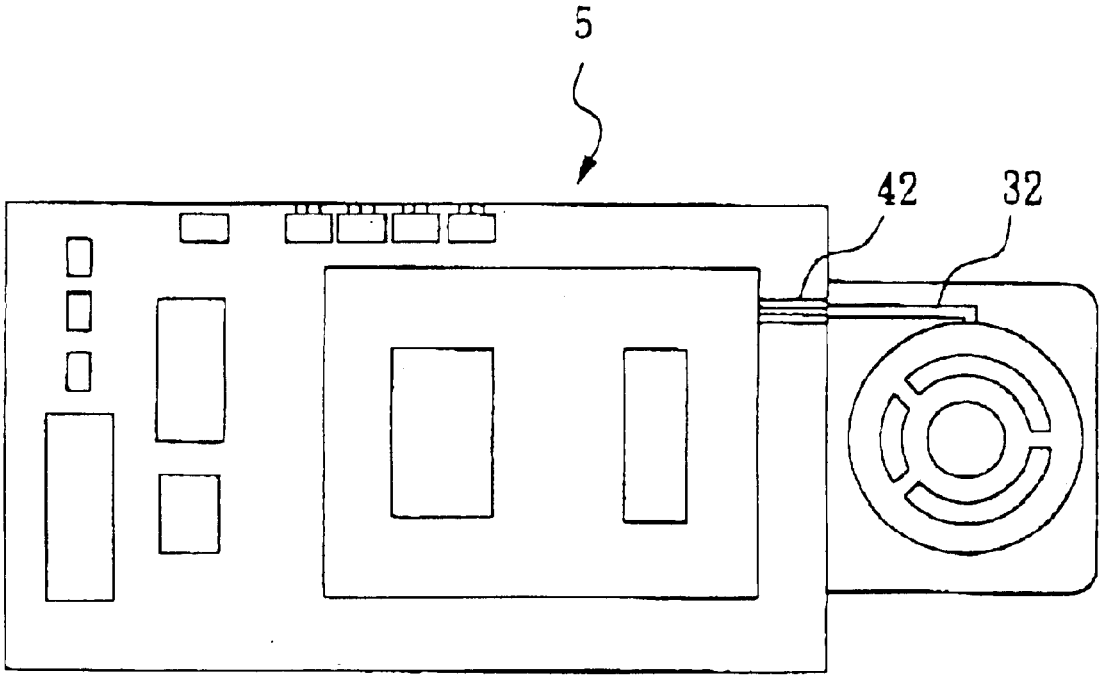
FIG. 2 is a connection diagram with microstrip line feed of the present invention.

FIG. 1 and FIG. 2 show the perspective view and connection diagram with microstrip line feed of the present invention. As shown, the PCB antenna includes a substrate 1, a emission electrode 2 and receiving units 31 and 32, wherein the emission electrode 2 further includes two circular electrodes 21 and 22 and three metal splices 23,24 and 25. The receiving unit 31 is connected with a signal processing unit 5 via an external transmission unit 41, and the receiving unit 32 is connected with the signal processing unit 5 via an external transmission unit 42.

The emission electrode 2 is printed on the substrate 1 via the PCB processing. In this preferred embodiment, the substrate 1 is an insulator, and the insulating material of the substrate 1 and the thickness of the substrate 1 can be selected as desired.

The size of the circular electrode 21 is larger than the size of the circular electrode 22. That is, the outer diameter of the circular electrode 22 is small than the inside diameter of the circular electrode 21, and there are three metal splices 23,24 and 25 that are connected with the circular electrodes 21 and 22 respectively between the circular electrode 21 and the circular electrode 22 so that the circular electrode 21 and the circular electrode 22 form a short circuit to obtain the best sensitivity.

In the preferred embodiment, the ratio of the outer diameter 211 of the circular electrode 21 to the inside diameter 212 of the circular electrode 21 is between 1.3~1.35, and the best ratio is 1.325. The ratio of the outer diameter 221 of the circular electrode 22 to the inside diameter 222 of the circular electrode 22 is between 1.65~1.75, and the best ratio is 1.7. The ratio of the inside diameter 212 of the circular electrode 21 to the outer diameter 221 of the circular electrode 22 is between 1.35~1.45, and the best ratio is 1.4.

In this preferred embodiment, the receiving unit 31 preferably uses coaxial fed, and the receiving unit 32 preferably uses microstrip fed. FIG. 1 shows the receiving unit 21 using a coaxial connection for connecting the external transmission unit 41 that has a shielding net so that the circular electrodes 21 and 22 are capable of receiving the co-polar signal and cross-polar signals at the same time, and then transmitting the co-polar signal and cross-polar signals to the signal processing unit 5. FIG. 2 shows the receiving unit 22 using microstrip line for transmitting the co-polar signal and cross-polar signals to the signal processing unit 5 via the external transmission unit 42 printed on the substrate 1.

Figure 3:
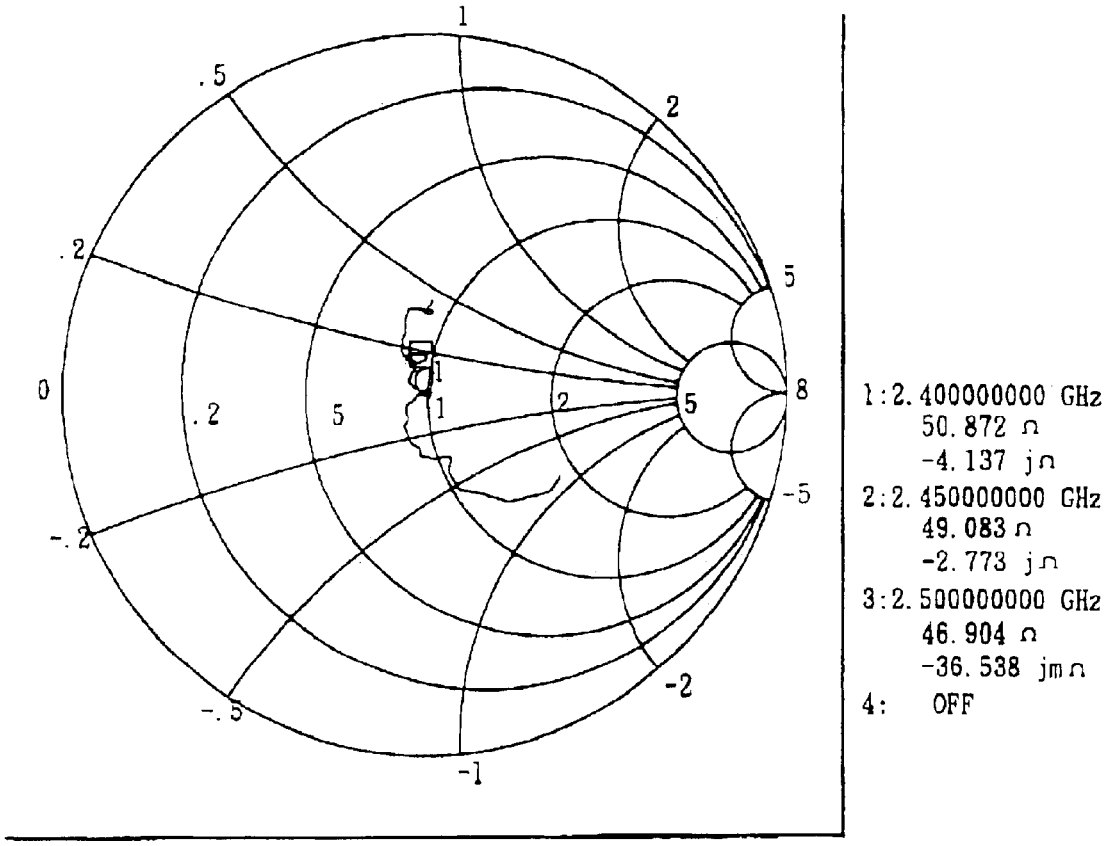
FIG. 3 is a Smith chart of the present invention.

FIG. 3 shows the Smith chart obtained from measuring the PCB antenna by a network analyzer. There are three major data in the FIG. 3. Namely, when the frequency is 2.4 GHz, the input impedance of the real part is 50.872 Ω and the input impedance of the imaginary part is (−4.137 j) Ω. When the frequency is 2.45 GHz, the input impedance of the real part is 49.083 Ω and the input impedance of the imaginary part is (−2.773 j) Ω. When the frequency is 2.5 GHz, the input impedance of the real part is 46.904 Ω and the input impedance of the imaginary part is (−936.538 j) mini Ω.

Figure 4:
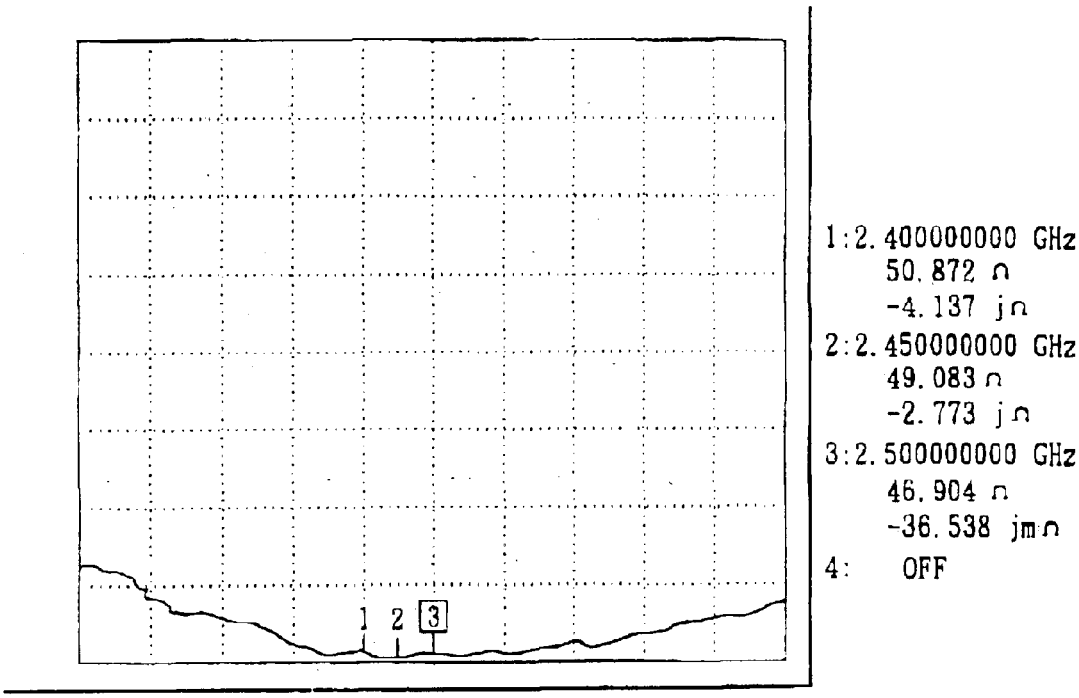
FIG. 4 is a diagram of the voltage standing wave ratio (VSWR) of the present invention.
Figure 5:
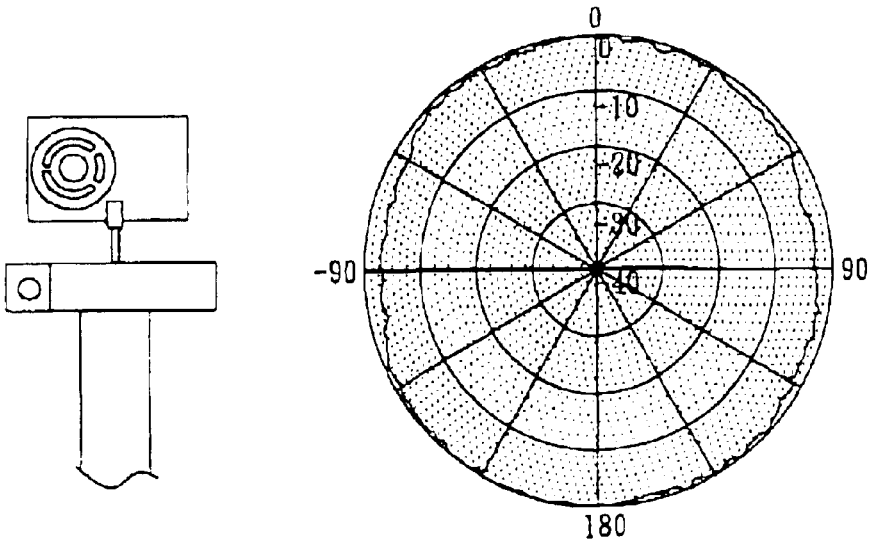
FIG. 5~FIG. 9 are the measuring result of the radiation pattern of the present invention in different angle.
Figure 6:
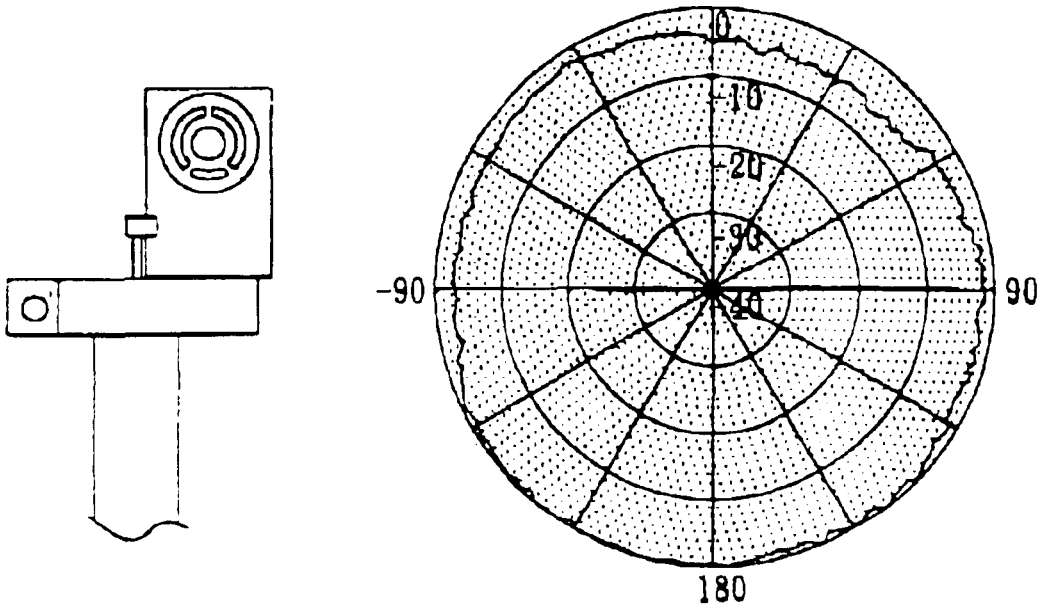
Figure 7:
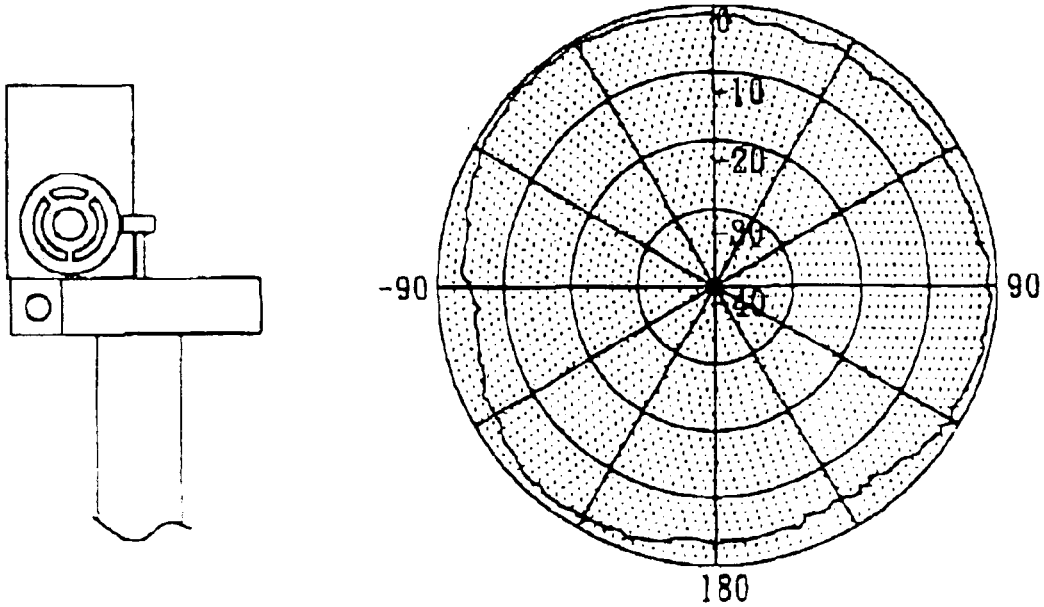
Figure 8:
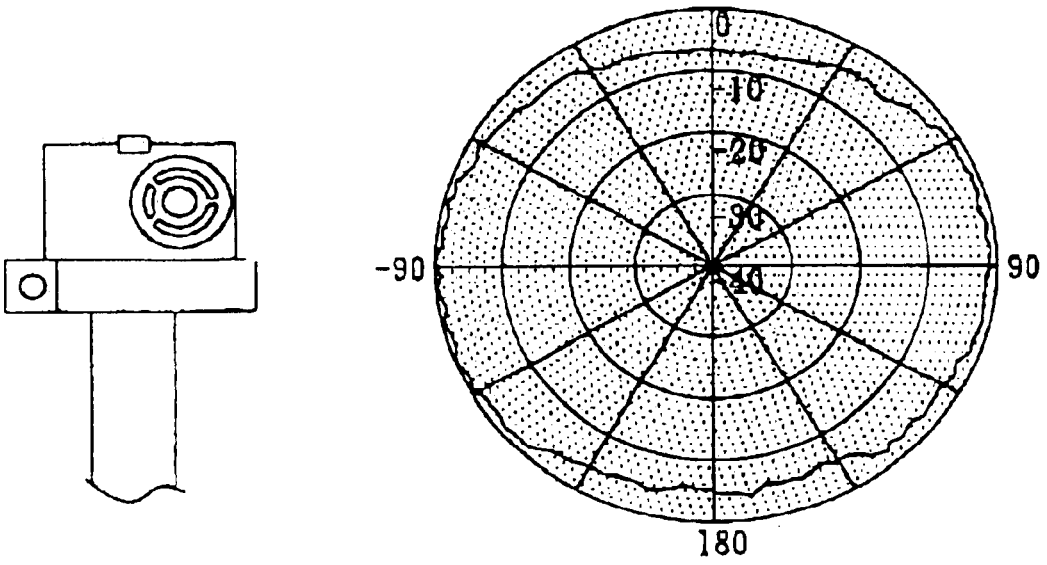
Figure 9:
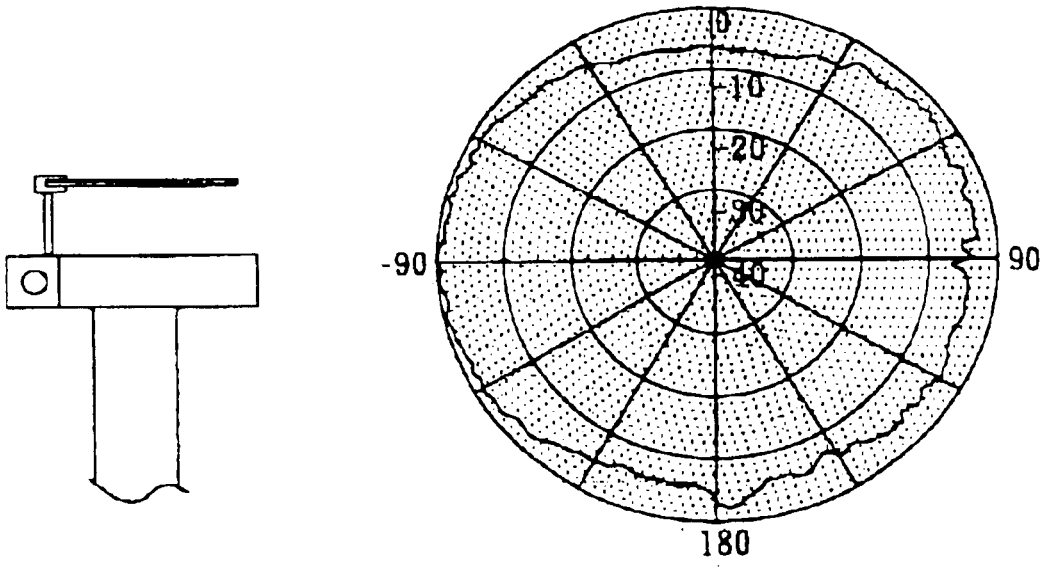

FIG. 4 shows the voltage standing wave ratio (VSWR) of the PCB antenna, wherein the chart represents the degree of the reflection. The VSWR of the prior PCB antenna is about three. The VSWR of the PCB antenna of the present invention is 1.103, 1.060 and 1.040 when the frequency is 2.4 GHz, 2.45 GHz and 2.5 GHz, respectively.

FIG. 5~FIG. 9 show the radiation pattern of the present invention in any angle. The PCB antenna of the present invention is capable of receiving any kind of polarization signals such as co-polarization signal and cross-polarization signal at the same time based on the radiation patterns for improving the sensitivity.

In brief, the present invention utilities a substrate printed with an emission unit having two circular electrodes of different sizes, wherein there are three metal splices connected with the two circular electrodes so that the two circular patterns form a short circuit to obtain the best sensitivity and receive the co-polarization signal and the cross-polarization signal at the same time.

Although the present invention has been explained in relation to its preferred embodiment, it is to be understood that many other possible modifications and variations can be made without departing from the spirit and scope of the invention as hereinafter claimed.

What is claimed is:

1. A PCB antenna for receiving different polarization signals operated with a signal processing unit, the PCB antenna comprising:

a substrate;

an emission electrode printed on the substrate, and having a plurality of circular electrodes and a plurality of metal splices for receiving a polarization signal, wherein the metal splices are located between the circular electrodes and respectively connected with each circular electrode; and a receiving unit located one of the ends of the substrate, and connected with the circular electrodes and the signal processing unit via an external transmission unit.

2. The PCB antenna as claimed in claim 1, wherein the circular electrodes include two circular electrodes of different sizes.

3. The PCB antenna as claimed in claim 2, wherein there are three metal splices connected with the two circular electrodes.

4. The PCB antenna as claimed in claim 2, wherein the two electrodes of different sizes have a first circular electrode and a second circular electrode, the first circular electrode having a first outer diameter and a first inside diameter, the second circular electrode having a second outer diameter and a second inside diameter, the first outer diameter being smaller than the second inside diameter.

5. The PCB antenna as claimed in claim 4, wherein the ratio of the first outer diameter to the first inside diameter is between 1.65~1.75.

6. The PCB antenna as claimed in claim 4, wherein the ratio of the second outer diameter to the second inside diameter is between 1.3~1.35.

7. The PCB antenna as claimed in claim 4, wherein the ratio of the second inside diameter to the first outer diameter is between 1.35~1.45.

8. The PCB antenna as claimed in claim 7, wherein the coaxial fed unit is connected with an external transmission line with a shielding net for being connected with the signal processing unit.

9. The PCB antenna as claimed in claim 7, wherein the microstrip fed unit is printed on the substrate and connected with the signal processing unit via the external transmission unit.

10. The PCB antenna as claimed in claim 1, wherein the receiving unit is a coaxial fed unit or a microstrip fed unit.

11. The PCB antenna as claimed in claim 1, wherein the polarization signal is co-polar signal or cross-polar signal.

* * * * *